US005556335A

United States Patent [19]

Holyoake

[11] Patent Number: 5,556,335

[45] Date of Patent: Sep. 17, 1996

[54] THERMALLY CONTROLLED DIFFUSERS

[75] Inventor: Noel V. Holyoake, Pakuranga, New Zealand

[73] Assignee: Holyoake Industries Limited, Auckland, New Zealand

[21] Appl. No.: 215,938

[22] Filed: Mar. 21, 1994

[30] Foreign Application Priority Data

Mar. 23, 1993 [NZ] New Zealand ..... 247231

[51] Int. Cl.[6] ..... F24F 11/02; F24F 13/06

[52] U.S. Cl. ..... 454/258; 236/49.5; 454/302

[58] Field of Search ..... 236/49.5; 454/258, 454/302, 303

[56] References Cited

U.S. PATENT DOCUMENTS 4,509,678 4/1985 Noll ..... 454/258 X
5,366,149 11/1994 Kline ..... 454/258 X

FOREIGN PATENT DOCUMENTS 2718298 10/1978 Germany ..... 454/302
3002229 7/1981 Germany ..... 236/49.5
1432146 4/1976 United Kingdom ..... 454/302
87/04775 8/1987 WIPO ..... 236/49.5

*Primary Examiner*—Harold Joyce
*Attorney, Agent, or Firm*—Abelman, Frayne & Schwab

[57] ABSTRACT

A thermally controlled diffuser comprises a means for connecting the diffuser to a duct, a divergent outlet, a means for deflecting flow from the divergent outlet, and a means for supporting the flow deflection means in a predetermined positional relationship with respect to the divergent outlet. The support means includes a temperature sensitive mechanism whereby the predetermined positional relationship between the outlet and the flow detection means may be varied depending on a temperature sensed by the temperature sensitive mechanism so as to produce a variation in the outlet flow pattern of the diffuser. The thermally controlled diffuser may preferably be a ceiling diffuser, and preferably the variation in the positional relationship is in a vertical direction when the diffuser is installed. A method of automatically varying the flow pattern of a diffuser is also described.

8 Claims, 4 Drawing Sheets

THERMALLY CONTROLLED DIFFUSERS

TECHNICAL FIELD

This invention relates to thermally controlled diffusers.

For convenience only, the present invention will be described with reference to thermally controlled ceiling diffusers, for which the invention may be particularly suitable. However it is to be understood that it is not to be limited as such. Moreover, because the invention may have many other applications, the prior art and possible applications of the invention as discussed below, are given by way of example only.

BACKGROUND ART

Outlets such as grills or ceiling diffusers are used in the air distribution systems of an air conditioning installation in order to control the direction and velocity, and consequent cooling or heating effect, of the outlet air. These devices generally comprise some form of divergent outlet which is connected to ducting of an air conditioning system supplying heating or cooling air to a room. In order to provide optimum air distribution in the room, flow deflection means such as vanes are provided at the divergent outlet.

A ceiling diffuser is generally used in the case of ceiling distribution of conditioned air. Such a diffuser may be round, square or linear in shape. When cooling is called for, an optimum cooling air distribution is achieved by projecting the cool primary air from the diffuser laterally across the ceiling. This minimises waste in cooling the warmer air in the region above occupants of the room, by providing cooling over the ceiling and walls and occupied floor region only. However, since the primary air is cooler and therefore more dense than the secondary room air it will tend to drop to the floor if lateral projection is not sufficient, so that ideal distribution and mixing with room air may not be achieved and draughts may result. The performance of the diffuser from a cooling point of view thus depends on the amount of lateral spread which can be achieved by the diffuser.

When heating is called for, optimum air distribution is achieved by projecting the heated primary air down to the floor. However, since the primary air is warmer and therefore less dense than the secondary room air, there is a tendency for the warmer air to stay at ceiling level. This lessens the effect of mixing of the primary air with the room air, resulting in a colder floor region with floor to ceiling stratification and wasteful heating of the ceiling region. The performance of the diffuser from a heating point of view thus depends on the ability of the diffuser to direct air downwards. Hence as well as ensuring comfort of the occupants, optimum air distribution is desirable to minimise heating or cooling loads by heating or cooling only those regions of the room where it is required.

To meet the dual requirements of a diffuser to be able to operate efficiently in both heating and cooling situations, with seasonal changes, variable geometry ceiling diffusers have been developed wherein the flow pattern may be varied depending upon requirements. Variation in geometry is generally achieved either manually or by electrically or pneumatically operated mechanisms which are controlled by a thermostat so as to adjust the diffuser configuration.

Disadvantages associated with systems involving electrically or pneumatically operated mechanisms are that they require external electrical or pneumatic connections, and are therefore invariably complicated and/or require periodic maintenance. Hence these systems are generally only economical where the savings in heating/cooling loads can justify the additional costs.

Systems involving manually operated mechanisms are generally used for lower cost installations. In these systems the diffuser mechanism is set once or twice a year at the time of change between heating and cooling demands. However as well as involving labour cost these systems are not able to cater for unseasonable changes in heating/cooling requirements, resulting in incorrect diffuser settings, causing discomfort and excessive heating/cooling loads.

As a lower cost alternative to the above variable geometry diffusers, a compromise may be achieved by having a fixed geometry diffuser which provides both a lateral spread and a downward flow pattern. Although the cost of this type of diffuser may be lower with no maintenance requirements, heating/cooling loads are inevitably higher due to the non-optimum room air distribution, and ideal comfort conditions may not therefore be achieved.

DISCLOSURE OF THE INVENTION

It is an object of the present invention to address the foregoing problems or at least to provide the public with a useful choice.

Further aspects and advantages of the present invention will become apparent from the ensuing description which is given by way of example only.

According to one aspect of the present invention there is provided a thermally controlled diffuser comprising:

a means for connecting said diffuser to a duct, a divergent outlet, a means for deflecting flow from said divergent outlet, and means for supporting said flow deflection means in a predetermined positional relationship with respect to the divergent outlet, wherein said support means includes a temperature sensitive mechanism whereby said positional relationship between said outlet and said flow deflection means may be varied depending on a temperature sensed by said temperature sensitive mechanism so as to produce a variation in the outlet flow pattern of the diffuser.

According to another aspect of the present invention there is provided a method of automatically varying the outlet flow pattern of a diffuser having a divergent outlet and a movable deflector plate, said method comprising the step of supporting the movable deflector plate relative to the divergent outlet by a support means incorporating a temperature sensitive mechanism, the arrangement and construction being such that the deflector plate is moved relative to the divergent outlet by said support means with variation in temperature of air flowing through the diffuser and sensed by the temperature sensitive mechanism, so as to produce said variation in outlet flow pattern.

By incorporating a temperature sensitive mechanism in the diffuser to vary the positional relationship between the deflector plate and the divergent outlet, the positional relationship of the deflector plate may be varied automatically with change in diffuser air temperature depending on the operating temperature characteristics of the temperature sensitive mechanism. Hence, when room cooling is required, the duct air temperature drops and at a predetermined temperature the deflector plate is moved to a positional relationship which produces an upward or a lateral discharge flow pattern from the diffuser for optimum cooling performance. Conversely when heating is required the duct air temperature increases and at a predetermined temperature, the deflector plate is moved to a positional relationship which produces a downward discharge flow pattern from the diffuser for optimum heating performance.

The predetermined temperature range at which the temperature sensitive mechanism operates may be varied depending on the required room temperatures for summer and winter conditions. For example the mechanism may operate to give a downward discharge pattern when the diffuser air temperature rises above 18° C., and to give an upward or a lateral discharge pattern when the temperature falls below 10° C.

Since the above arrangement enables, optimum diffuser configuration to be automatically provided for both heating and cooling, energy losses may be minimised and occupant comfort improved compared to systems using dual purpose diffusers. Furthermore, since the system is automatic, the inconvenience and cost involved with manual setting type diffusers may be avoided.

By having the temperature sensitive mechanism combined as a unit in the diffuser without the requirement for external electrical or pneumatic connections, both manufacturing and maintenance costs may be minimised compared to systems using conventional variable geometry diffusers.

Furthermore, since in the majority of applications, variation of geometry is only required once or twice a year, a simple mechanically operated mechanism will generally be sufficient, thereby further reducing costs while still achieving benefits of optimum heating/cooling air distribution.

With the above described diffuser, basic components such as the duct connection means and divergent outlet may be similar to those used in conventional multi purpose or variable geometry diffusers. For example the divergent outlet may be rectangular, square or circular in shape. However since an object of the outlet design is to provide both a cooling or a heating flow pattern depending on the positional relationship of the deflector plate, the shape of the walls of the divergent outlet may differ from that of conventional multi-purpose diffusers which are designed to provide a compromised heating/cooling flow pattern. In the case of a wall diffuser the shape of the walls of the divergent outlet may be such as to enable either an upward or a downward flow pattern depending on the location of the deflector plate, while for a ceiling diffuser the shape may be such as to enable either a lateral or a downward flow pattern depending on the location of the deflector plate.

The flow deflection means may comprise any suitable air flow deflection means which, in combination with the outlet, will enable the desired cooling or heating flow pattern depending on the positional arrangement between the two. In the case of a wall diffuser this may be a deflection means which will provide either an upward or downward flow pattern, while in the case of a ceiling diffuser this may be a deflection means which will provide either lateral or downward flow patterns. For example, a suitable flow deflection means for a ceiling diffuser having an axially symmetric divergent outlet may comprise a simple flat circular plate whereby an annular outlet may be formed between the edge of the plate and the peripheral walls of the divergent outlet. By moving the plate in a downward direction from the outlet, flow deflected laterally by the plate is able to spread laterally from the diffuser outlet, while by moving the plate in an upward direction, laterally deflected flow is diverted by the peripheral walls of the divergent outlet to be deflected downwards.

In the case of a wall diffuser, the flow deflection means may have vanes which may be moved between one position wherein discharge air is deflected to give a downward flow pattern, and another position wherein discharge air is deflected to give an upward flow pattern.

However, the present invention is not limited to the above arrangements and any other type of deflection means and outlet arrangement which achieves a similar effect may be possible.

The support means may involve any suitable mechanism whereby an element may be movably supported relative to an other. Preferably the support means may comprise a mounting member and an operating member whereby it is mechanically connected between the deflection means and the divergent outlet. The temperature sensitive mechanism may be incorporated into the support means so as to cause movement between the mounting member and the operating member with change in ambient temperature. The temperature sensitive mechanism may comprise any suitable element which changes in physical dimensions with change in ambient temperature, with the element being arranged in the mechanism such that the change causes variation in the positional relationship between the mounting member and the operating member and consequently between the deflection means and the divergent outlet. For example the temperature sensitive mechanism may include mechanisms involving changes with temperature of the pressure of a gas such as with gas filled chambers used in temperature gauges, or the physical dimensions of a solid as with bimetallic strips, or the properties or molecular structure of a solid as with memory metals. Since a relatively large change in positional relationship between the flow deflection means and the divergent outlet in desirable at room temperatures, a suitably designed bi-metallic coil or a memory metal device may be most suitable.

The support means may further comprise a link means connected between the operating member and the deflection means or the divergent outlet. The link means may enable adjustment of the positional relationship between a deflector plate of the deflection means and the divergent outlet at the time of installation. The link means may also provide a mechanical advantage, or movement amplification and allow for a change in direction of operating forces. Furthermore, the link means may ensure that loading is directly transmitted between the operating member and the deflector plate. For example, with a ceiling diffuser, a simple chain link may be provided between the operating member and an attachment on the deflector plate. The chain length may be easily adjusted by attachment at an appropriate link, and any misalignment of force may be accommodated by alignment at the links.

An increase in mechanical advantage so that a heavy deflector plate may be moved with minimal force may be achieved by having a cam face connected to the deflector plate with a cam follower connected to the operating member. Movement of the cam follower against the cam face may thus produce a required movement of the deflector plate. Also with this arrangement, movement of the operating member in one direction may be converted into a movement of the deflector plate in another direction.

The diffuser may also be provided with a cover plate so as to shield movement of the deflector plate from view when the diffuser is installed in a room, and also to protect the movable deflector plate.

Although the diffuser of the present invention may be suitable for both wall or ceiling mounted diffusers, it is generally envisaged that the invention would be most suitable for ceiling diffusers, since in this application, a simpler arrangement whereby the deflector plate is simply hung from the support means may be used. Furthermore, in ceiling applications, since the diffuser is out of reach, a less robust mechanism may be suitable.

Further aspects of the present invention will become apparent from the ensuing description which is given by way of example only and with reference to the accompanying drawings.

BEST MODE FOR CARRYING OUT THE INVENTION

Figure 1:
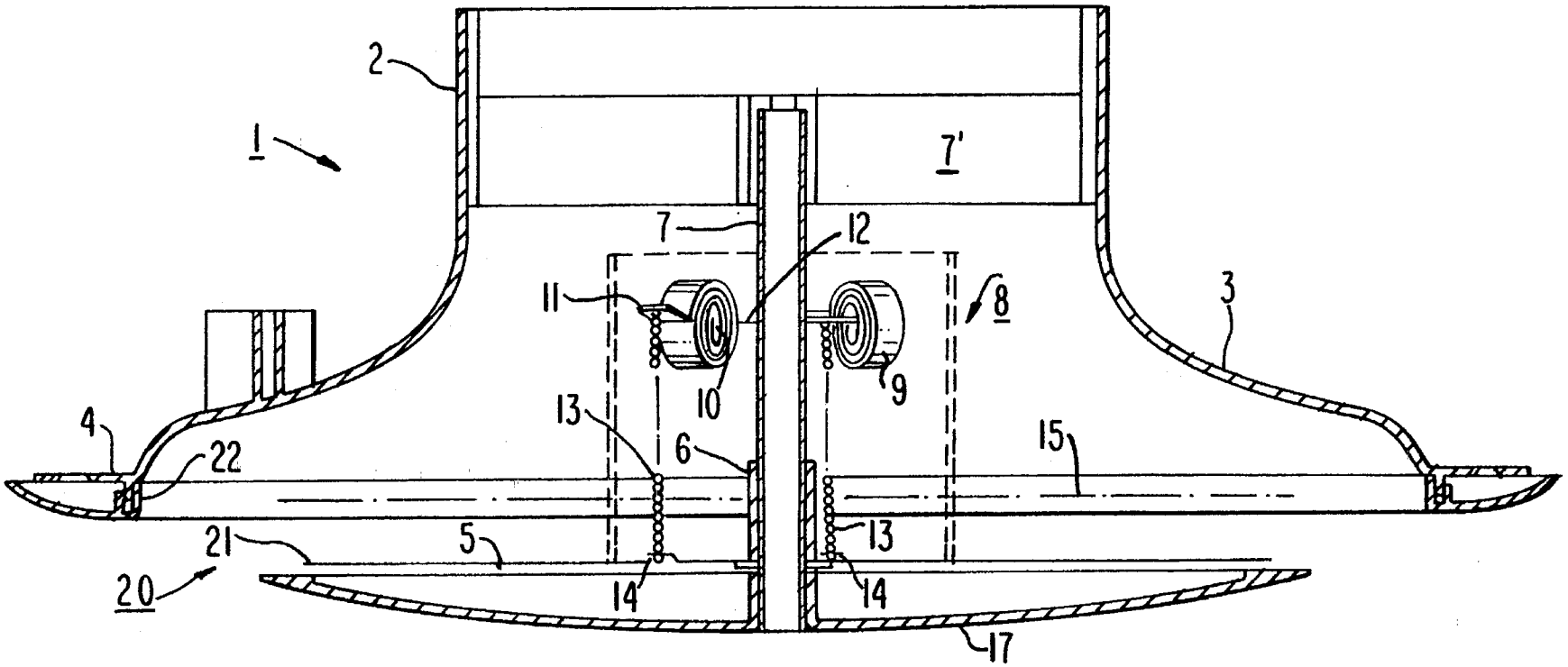
FIG. 1 is a sectional view of a thermally controlled ceiling diffuser according to a first embodiment of the present invention.

As shown in FIG. 1 a thermally controlled ceiling diffuser generally indicated by arrow 1 comprises a circular duct connector 2 whereby the diffuser may be connected to the ducting of an air conditioning system installed above the ceiling. The duct connector 2 is formed integrally with an axially symmetric divergent outlet 3 provided with an attachment flange 4 at an outer rim thereof whereby the diffuser 1 may be fixed to a ceiling panel. A flow deflector in the form of a circular disc 5 is centrally located in the outlet 3 by means of a cylindrical bearing 6 which slides freely on an axially aligned rod 7. The rod 7 is fixed relative to the outlet 3 at an upper end thereof by support vanes 7' positioned in the vicinity of the duct connector 2 and fixed to an inner wall thereof. The cylindrical bearing 6 is fitted with a plastic bushings (not visible in the figure) having four circumferentially spaced longitudinally aligned ridges so that frictional resistance to axial movement up and down the rod 7 is minimised. The deflector plate 5 is further supported relative to the outlet 3 by a support means generally indicated by arrow 8 and including a temperature sensitive mechanism in the form of bimetallic strips formed as coils 9 with inner ends bent to form mounting members 10 and outer ends bent to form operating members 11. The mounting members 10 are attached to brackets 12 fixed to the rod 7, while the operating members 11 are attached to the deflector plate 5 by ball chains 13.

Although not visible in the figure three such bimetallic coils 9 are mounted at equiangular spacing around the rod 7 on three brackets 12, and are connected to the deflector plate 5 by three ball chains 13 so as to provide a stable support to the deflector plate 5. The ball chains 13 are connected to the deflector plate 5 by threading the ball links of the chain through slotted holes 14 formed in the plate 5, and engaging the appropriate ball in the slot. In this way the length of the chains 13 may be easily varied to provide the correct alignment and positional relationship between the p late 5 and the outlet 3 at installation. Furthermore, by having a flexible chain 13 the chain naturally aligns with the tension force in the chain, and if a wide range of movement is required the chain 13 can wind onto the outer surface of the coil 9.

With such an arrangement, variation in temperature of ambient air around the bimetallic coil 9 results in the operating member 11 of the coil 9 moving so as to raise or lower the deflector plate 5. As a result the positional relationship between the outlet 3 and the flow deflector 5 may be varied in a vertical sense depending on the temperature of the bimetallic coil 9.

In the present embodiment bimetallic coils which operate effectively over the required temperature range are used for the bimetallic coils 9. The deflector plate 5 is set relative to the opening 3 so as to move from the lower limit shown in FIG. 1 to an upper limit shown by the dotted line 15 with an increase in temperature of the coils 9 from around 10° C. to 18° C. Further upward movement of the deflector plate 5 is prevented by the bearing 6 contacting the bracket 12. With a decrease in temperature of the coils 9 below around 10° C. the deflector plate 5 moves to the lower limit where it rests on a cover plate 17 mounted on the shaft 7. The cover plate 17 also acts to protect the deflector plate 5, and shield it from view.

With the construction shown in FIG. 1 the deflector plate 5 is symmetrically disposed relative to the divergent outlet 3 so as to form an annular outlet 20 defined by an outer rim 21 of the deflector plate 5 and a rim 22 of the outlet 3. The walls of the outlet 3 in the region of the rim 22 are shaped such that outlet air striking the walls is diverted downwards to provide a downward flow pattern from the diffuser 2. Hence if the deflector plate 5 is raised to the upper level shown by the dotted line 15, air deflected laterally by the deflector plate 5 is diverted down by the walls of the outlet so that a downwards flow pattern results. With the deflector plate in the lower position as shown in FIG. 1 however, air deflected in a lateral direction by the deflector plate 5 is able to continue in the lateral direction so that a lateral flow pattern results.

Figure 2:
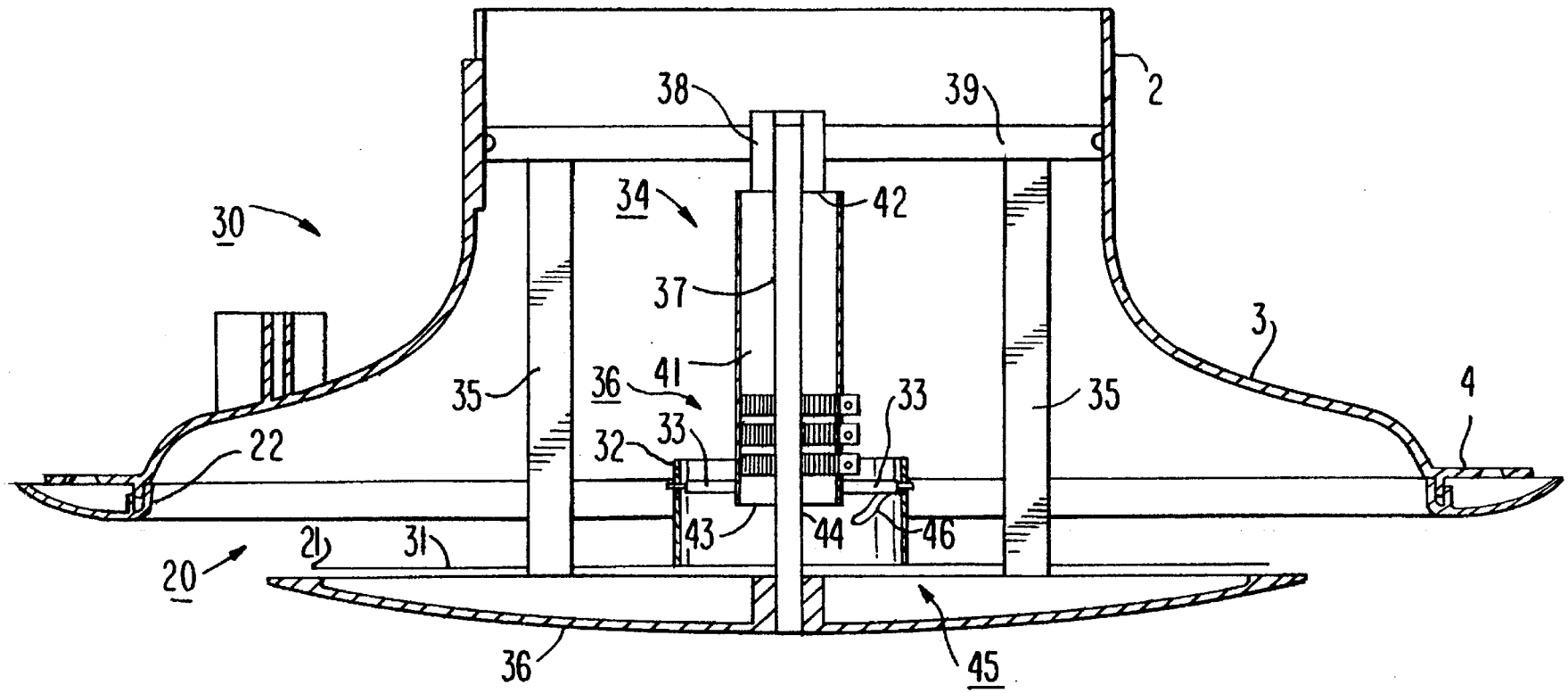
FIG. 2 is a cross sectional view through a vertical axis of a ceiling diffuser according to a second embodiment of the present invention.
Figure 3:
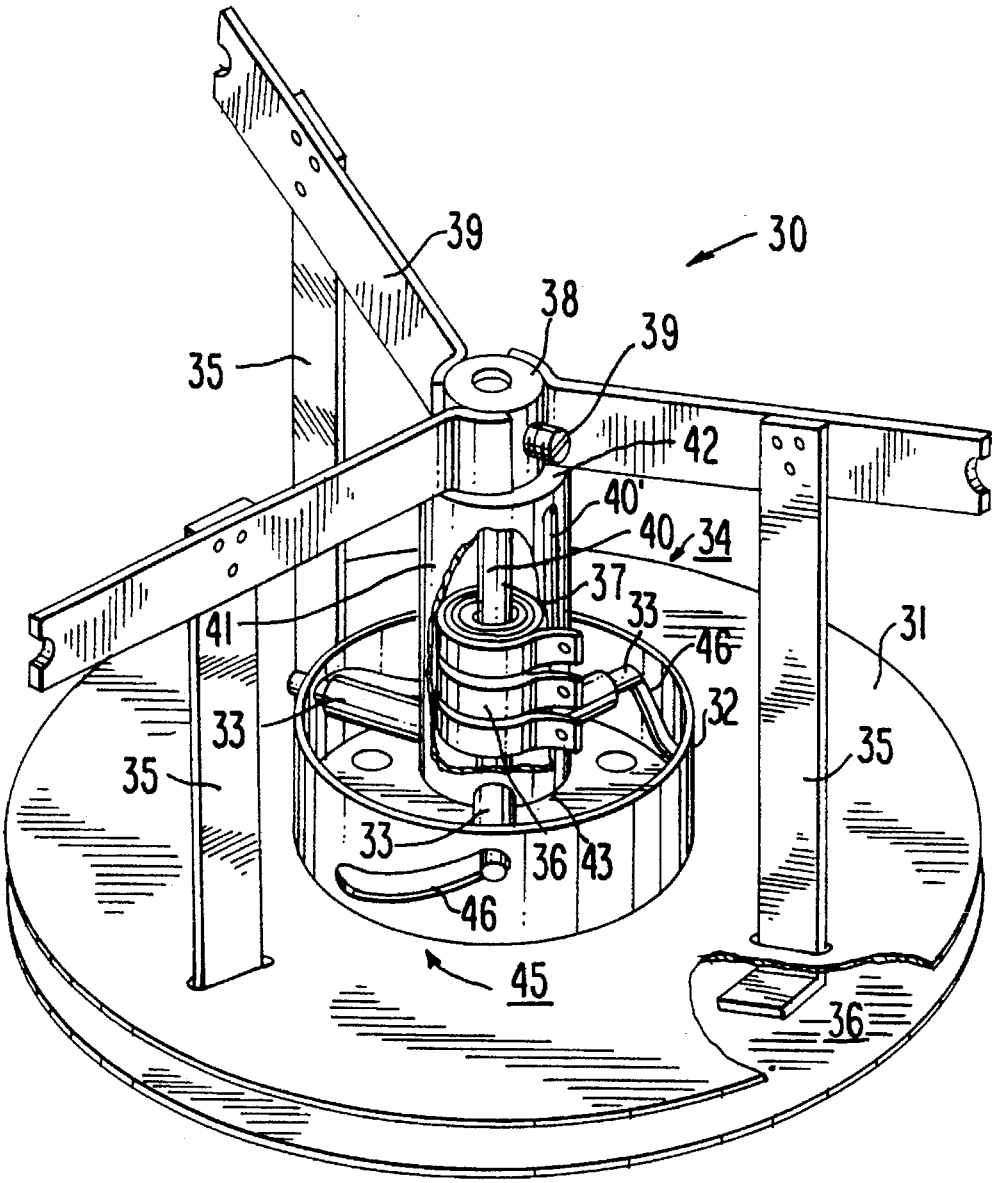
FIG. 3 is a schematic perspective view of the second embodiment of FIG. 2.

A second embodiment of the present invention is shown in FIGS. 2 and 3. In this embodiment elements having a similar function to those of the first embodiment are indicated with the same numerals and description is omitted for brevity.

As shown in FIGS. 2 and 3 a thermally controlled ceiling diffuser generally indicated by arrow 30 comprises a duct connector 2, and a divergent outlet 3 as with the previous embodiment. A flow deflector in the form of a circular disc 31 with a centrally disposed cylindrical member 32 is supported centrally and vertically in the outlet 3 by means of three drive arms 33 of a support means generally indicated by arrow 34. Rotation of the disc 31 relative to the outlet 3 is prevented by three cover plate suspension brackets 35 which support a cover plate 36 provided to protect the disc 31 and shield it from view.

The support means 34 incorporates a temperature sensitive mechanism having three bimetallic coils generally indicated by arrow 36', similar to those used in the previous embodiment. However in this embodiment the coils 36' are arranged coaxially around a support shaft 37. The support shaft 37 which acts as a mounting member of the support means 34, is connected to the divergent outlet 3 by means of a collar 38 mounted on a spider 39 fitted into the duct connector 2. Vertical adjustment of the support shaft 37 relative to the outlet 3, and hence adjustment of the disc 31 relative to the outlet 3, is achieved by a grub screw 39 which clamps the support shaft 37 in the collar 38 at the required position.

Inner ends of the coils 36' are fitted into an axial slot 40 formed in the shaft 37 to provide a mechanical connection between the coils 36' and the support shaft 37, while the operating ends of the coils 36' project through an axial slot 40' formed in the wall of a cylinder 41 which is rotatably mounted coaxially with the shaft 37 by means of upper and lower end plates 42, 43 respectively. The arms 33 which act as operating members of the support means 34, are fixedly attached to the cylinder 41 so as to rotate as one with the cylinder 41. Vertical support of the cylinder 41 is provided by a thrust bearing 44 in contact with the lower end plate 43.

The arms 33 are attached to the disc 31 by way of a linkage generally indicated by arrow 45 which comprises a directional change mechanism having three cam slots 46 formed in the cylindrical member 32 which engage with the three ends of the rods 33. Movement of the rods 33 relative to the cam slots 46 causes the cylindrical member 32 (which is prevented from rotation by the suspension brackets 35) to move in an axially upward or downward direction together with the disc 31.

With such an arrangement, as with the previous embodiment of FIG. 1, variation in temperature of ambient air around the bimetallic coils 36' results in the operating ends of the coils 36' moving so as to rotate the cylinder 41 and arms 33 thereby causing the disc 31 to move upward or downward depending on the direction of rotation of the arms 33. As a result the positional relationship between the outlet 3 and the disc 31 may be varied in a vertical sense depending on the temperature of the bimetallic coils 36'. In this embodiment upward and downward limits to movement of the disc 31 are provided by the ends of the cam slot 46.

Figure 4:
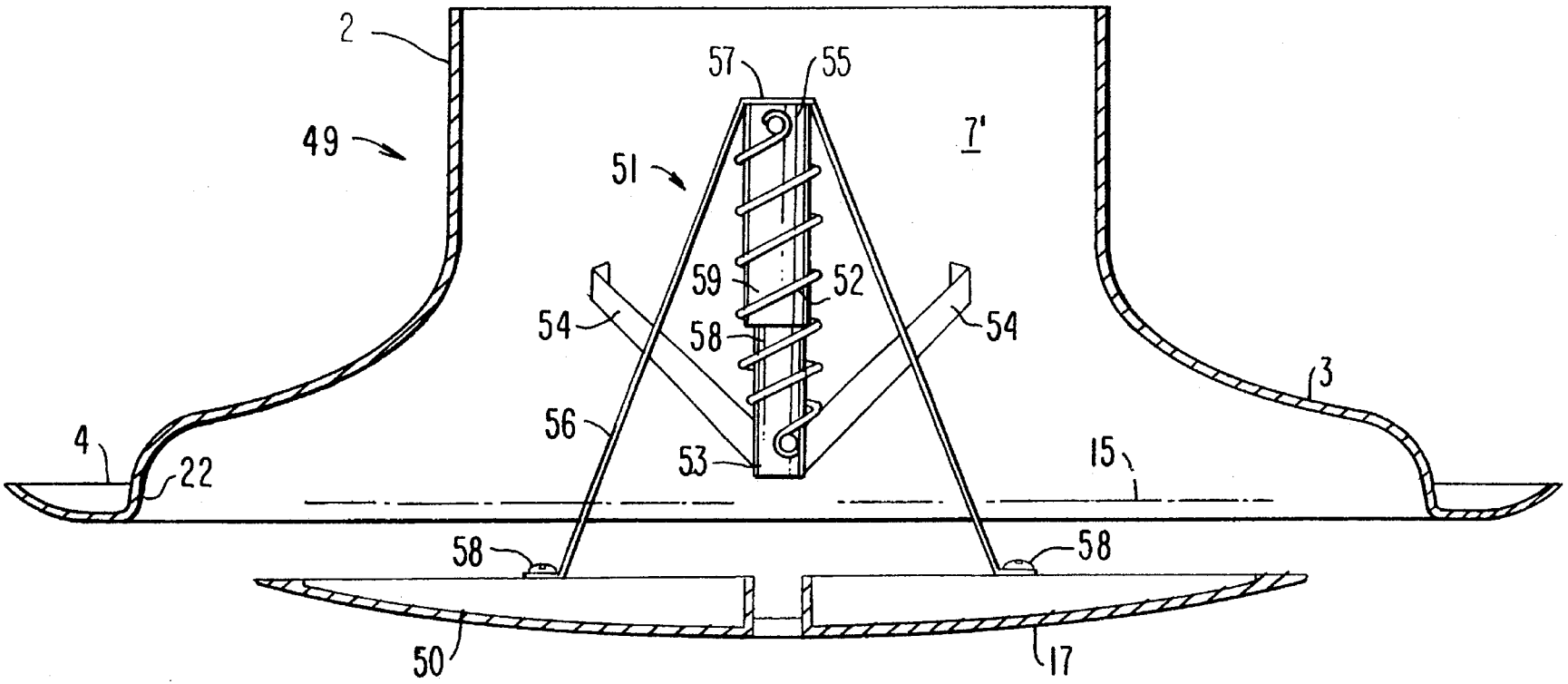
FIG. 4 is a sectional view of a thermally controlled ceiling diffuser according to a third embodiment of the present invention.

A thermally controlled ceiling diffuser generally indicated by arrow 49 according to a third embodiment of the present invention is shown in FIG. 4. The diffuser 49 of this embodiment is similar to that of the first and second embodiments, and elements having a similar function thereto are indicated with the same numerals.

The thermally controlled ceiling diffuser 49 differs from that of the first and second embodiments in that there are no separate cover plates 17 and 36 respectively. Instead, a deflector plate 50 is provided which is designed to also provide an aesthetic covering to the opening of the outlet 3. Furthermore, the support means which supports the deflector plate 50 relative to the outlet 3, comprises a temperature sensitive mechanism in the form of a thermally extended device generally indicated by arrow 51, and a tension coil spring 52. The thermally extended device 51 is supported relative to the outlet 3 at a fixed end 53 by three support arms 54 (only two shown in FIG. 4). The deflector plate 50 is supported relative to a movable end 55 by means of a strip member 56 which is attached at a central portion 57 thereof to the movable end 55, and at opposite ends to the deflector plate 50 with fasteners 58.

Although not shown in detail in FIG. 4, the thermally extended device 51 essentially comprises a cylindrical fixed member 58' which slides inside a tubular shaped movable member 59, the sliding fit being such as to allow axial relative movement while providing stable lateral support in other directions. An operating element (not shown), made from a material having a high coefficient of thermal expansion such as a wax type phase change material, is provided between oppositely facing ends of the fixed member 58' and the movable member 59. The operating element causes separation of the members 58', 59 with expansion of the operating element, and causes or allows the members 58', 59 to be drawn together under action of the tension spring 52 with contraction of the operating element.

Operation of the diffuser 49 is similar to that of the first embodiment in that the deflector plate 50 moves from a lower limit position as shown in FIG. 4 to an upper limit position shown by the dotted line 15 with an increase in temperature which causes the thermally extended device 51 to expand. Similarly, the deflector plate 50 moves back to the lower limit position with a decrease in temperature and consequent contraction of the thermally extended device 51.

The first and second embodiments of the present invention have the upper and lower limits set by mechanical restrictions to movement. That is, with the first embodiment the upper limit involves the bearing 6 contacting the bracket 12 and the lower limit involves the deflector plate 5 resting on the cover plate 17, whereas, with the second embodiment the upper and lower limits to the movement of the disc 31 are provided by the ends of the cam slot 46. In contrast, in the third embodiment the upper and lower limits are dependent only on the length and expansion characteristics of the thermally extended device 51. The number of components can thus be reduced with a simplified construction, enabling a reduction in manufacturing and maintenance costs.

INDUSTRIAL APPLICABILITY

Thermally controlled diffusers such as those described above have several advantages over conventional variable geometry diffusers as follows, however it should be appreciated that all such advantages may not be realised on all embodiments of the invention, and the following list is given by way of example only as being indicative of potential advantages of the present invention. Furthermore, it is not intended that the advantages of the present invention be restricted to those of the list which follows:

1. By incorporating a temperature sensitive mechanism into the support for the deflector plate of a diffuser outlet, the deflector plate may be automatically adjusted to provide a heating or cooling outlet flow pattern, without the need for external pneumatic or electrical connections. A variable geometry diffuser may thus be installed in relatively low cost air conditioning systems which do not have provision for electrical or pneumatic operation of the diffusers.
2. The design enables simple adjustment of the deflector plate relative to the divergent outlet on installation, or alternatively this may be factory set, thereby avoiding incorrect adjustment at installation.
3. A simple low cost bi-metallic coil may be used for the temperature sensitive mechanism so that a low cost variable geometry diffuser may be produced.
4. The use of a thermally extended device for the temperature sensitive mechanism which also provides lateral support, enables the deflector plate to be positionally located relative to the diffuser outlet, without the need for additional support. Hence construction can be simplified, and separate upper and lower limits to movement of the deflector plate can be eliminated.
5. Due to the reduction in costs which are possible by use of the thermally controlled diffusers of the present invention, energy savings may be obtained with lower cost air conditioning systems.

Aspects of the present invention have been described by way of example only and it should be appreciated that modifications and additions may be made thereto without departing from the scope thereof as defined in the appended claims.

What we claim is:

1. A thermally controlled diffuser comprising:

means for connecting said diffuser to a duct, a divergent outlet, means for deflecting flow from said divergent outlet, and support means for supporting said means for deflecting flow in a predetermined positional relationship with respect to said divergent outlet, wherein said support means includes a fixed member, a movable member which is coaxial with said fixed member and slides longitudinally with respect to said fixed member, and a temperature sensitive mechanism interposed between said fixed member and said movable member, whereby said positional relationship between said outlet and said means for deflecting flow may be varied depending on a temperature sensed by said temperature sensitive mechanism so as to produce a variation in the outlet flow pattern of said diffuser;

said means for deflecting flow being movable from a position within said divergent outlet to a postion spaced outwardly of said divergent outlet, and being of lesser radial extent than the radial extent of the outlet of said divergent outlet;

whereby, when said means for deflecting flow is located within said divergent outlet, exiting air is constrained to move axially outwards of said divergent outlet, and, when said means for deflecting flow is spaced outwardly of said divergent outlet, exiting air is constrained to move radially outwards of said divergent outlet.

2. A thermally controlled diffuser as claimed in claim 1, wherein said divergent outlet and said means for deflecting flow are configured such that said means for deflecting flow moves in a substantially vertical direction with respect to said divergent outlet.

3. A thermally controlled diffuser as claimed in claim 1, wherein said temperature sensitive mechanism comprises an element which changes in physical dimensions with change in ambient temperature, said element being arranged in said mechanism such that said change in physical dimensions causes relative movement between said fixed member and said movable member.

4. A thermally controlled diffuser as claimed in claim 1, wherein said means for deflecting flow is connected to said movable member in such as way so as to follow the movement of said movable member.

5. A thermally controlled diffuser as claimed in claim 1 wherein said diffuser further comprises a cover plate, the arrangement and construction being such that said means for deflecting flow is substantially shielded from view when said diffuser is installed in a room.

6. A thermally controlled ceiling diffuser comprising an axially symmetric divergent outlet, a flow deflector in the form of a circular plate, and means for supporting said plate in a predetermined positional relationship with respect to said divergent outlet, wherein said support means comprises a temperature sensitive mechanism and a means for producing tension, said temperature sensitive mechanism including a movable member and a fixed member and configured to allow separation of said movable and fixed members upon a sensed increase in temperature, said separation being opposed by said means for producing tension, said temperature sensitive mechanism and said means for producing tension being mechanically connected between said divergent outlet and said circular plate, the arrangement and construction being such that a change in the physical dimensions of said temperature sensitive mechanism results in a change in said positional relationship, said change in said positional relationship being characterized by said flow deflector being movable from a position substantially within said divergent outlet to a position spaced substantially outwardly of said divergent outlet, said circular plate being of lesser radial extent than the radial extent of the outlet of said divergent outlet.

7. A method of automatically varying the flow pattern of a diffuser having a divergent outlet and a movable deflector plate, said method comprising the step of supporting said movable deflector plate relative to said divergent outlet by a support means incorporating a temperature sensitive mechanism and a means for producing tension, said temperature sensitive mechanism including a movable member and a fixed member, said means for producing tension opposing movement of said movable member away from said fixed member, the arrangement and construction of said diffuser being such that said deflector plate is moved relative to said divergent outlet by said support means with variation in temperature of air flowing through said diffuser and sensed by said temperature sensitive mechanism, so as to produce said variation in said flow pattern, said movement of said deflector plate being characterized by said deflector plate being movable from a position substantially within said divergent outlet to a position spaced substantially outwardly of said divergent outlet, said deflector plate being of lesser radial extent than the radial extent of the outlet of said divergent outlet.

8. A method of automatically varying the flow pattern of a ceiling diffuser having an axially symmetric divergent outlet and a low deflector in the form of a circular plate, said method comprising the step of supporting said circular plate relative to said outlet by a support means incorporating a temperature sensitive mechanism and a means for producing tension, said temperature sensitive mechanism including a movable member and a fixed member, said means for producing tension opposing movement of said movable member away from said fixed member, the arrangement and construction of said diffuser being such that said circular plate is moved relative to said divergent outlet by said support means with variation in temperature of air flowing through said ceiling diffuser and sensed by said temperature sensitive mechanism, so as to produce said variation in said flow pattern, said movement of said circular plate being characterized by said circular plate being movable from a position substantially within said divergent outlet to a position spaced substantially outwardly of said divergent outlet, said circular plate being of lesser radial extent than the radial extent of the outlet of said divergent outlet.

* * * * *